US010593306B2

(12) United States Patent
Taniguchi et al.

(10) Patent No.: US 10,593,306 B2
(45) Date of Patent: Mar. 17, 2020

(54) KEYBOARD INSTRUMENT

(71) Applicant: CASIO COMPUTER CO., LTD., Shibuya-ku, Tokyo (JP)

(72) Inventors: Hirokazu Taniguchi, Tachikawa (JP); Akihito Akaishi, Hino (JP); Akihisa Hoshino, Fussa (JP)

(73) Assignee: CASIO COMPUTER CO., LTD., Toyko (JP)

( * ) Notice: Subject to any disclaimer, the term of this patent is extended or adjusted under 35 U.S.C. 154(b) by 0 days.

(21) Appl. No.: 16/445,266

(22) Filed: Jun. 19, 2019

(65) Prior Publication Data

US 2019/0392787 A1 Dec. 26, 2019

(30) Foreign Application Priority Data

Jun. 21, 2018 (JP) ..... 2018-117717

(51) Int. Cl.
*G10D 3/12* (2006.01)
*G10C 3/12* (2006.01)

(52) U.S. Cl.
CPC ..... *G10C 3/12* (2013.01)

(58) Field of Classification Search
CPC ..... G10C 3/12; G10C 3/00
See application file for complete search history.

(56) References Cited

U.S. PATENT DOCUMENTS 3,248,992 A 5/1966 Wood et al.
3,738,216 A 6/1973 Slaats et al.
8,110,732 B2 2/2012 Shimoda
8,350,140 B2 1/2013 Taniguchi
8,969,698 B1 * 3/2015 Suzuki ..... G10C 3/12 84/436
2011/0017049 A1 1/2011 Shimoda
2012/0000347 A1 1/2012 Taniguchi

FOREIGN PATENT DOCUMENTS

JP 01085795 U 6/1989
JP 2011027854 A 2/2011
JP 2013073099 A 4/2013
WO 2017163982 A1 9/2017

OTHER PUBLICATIONS

Extended European Search Report (EESR) dated Nov. 21, 2019 issued in European Application No. 19181081.1.

* cited by examiner

*Primary Examiner* — Kimberly R Lockett
(74) *Attorney, Agent, or Firm* — Holtz, Holtz & Volek PC

(57) ABSTRACT

A keyboard instrument including a plurality of keys and a keyboard chassis, in which each key has a shaft or a shaft hole provided on one end side thereof. The keyboard chassis is provided with shafts when the plurality of keys has shaft holes, and is provided with shaft holes when the plurality of keys has shafts. This keyboard chassis supports the plurality of keys by the shafts being arranged in the shaft holes. Also, first spaces and second spaces are formed between an inner surface of the shaft hole and the shaft. The first spaces are positioned in a vertical direction of the key, and the second spaces are positioned in a longitudinal direction of the key. In addition, the second spaces are larger than the first spaces.

17 Claims, 13 Drawing Sheets

KEYBOARD INSTRUMENT

CROSS-REFERENCE TO RELATED APPLICATION

This application is based upon and claims the benefit of priority from the prior Japanese Patent Application No. 2018-117717, filed Jun. 21, 2018, the entire contents of which is incorporated herein by reference.

BACKGROUND OF THE INVENTION

1. Field of the Invention

The present invention relates to a keyboard instrument such as an electronic piano.

2. Description of the Related Art

For example, a keyboard instrument is known which has a structure where a pair of key supporting pieces which holds therebetween a pair of attachment pieces provided on the rear part of a key is provided on a rear portion of a keyboard chassis where the key is arranged, and shaft sections provided on the pair of attachment pieces are inserted into shaft holes provided in the pair of key supporting pieces so that the key is rotatably attached to the keyboard chassis, as disclosed in Japanese Utility-Model Application Laid-Open (Kokai) Publication No. 01-085795.

SUMMARY OF THE INVENTION

In accordance with one aspect of the present invention, there is provided a keyboard instrument comprising: a plurality of keys; and a keyboard chassis, wherein each key has a shaft or a shaft hole provided on one end side thereof, wherein the keyboard chassis is provided with shafts when the plurality of keys has shaft holes, and is provided with shaft holes when the plurality of keys has shafts, wherein the keyboard chassis supports the plurality of keys by the shafts being arranged in the shaft holes, wherein first spaces and second spaces are formed between an inner surface of the shaft hole and the shaft, wherein the first spaces are positioned in a vertical direction of the key, and the second spaces are positioned in a longitudinal direction of the key, and wherein the second spaces are larger than the first spaces.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 4A and FIG. 4B are diagrams showing an attachment section of a key and a key supporting section of a keyboard chassis in the keyboard instrument shown in FIG. 1, of which FIG. 4A is an exploded perspective view of a main portion, and FIG. 4B is an enlarged view of the main portion showing a corresponding relation between a shaft hole and a shaft section;

FIG. 6A to FIG. 6C are diagrams showing a white key of the keyboard instrument shown in FIG. 2; of which FIG. 6A is a side view of the white key, FIG. 6B is a planar view of the white key, and FIG. 6C is a front view of the white key;

FIG. 9A and FIG. 9B are diagrams showing white keys corresponding to "C", "E", "G" and "B" among all the white keys of the keyboard instrument shown in FIG. 1, of which FIG. 9A is a planar view and FIG. 9B is a side view;

FIG. 10A and FIG. 10B are diagrams showing white keys corresponding to "D", "F" and "A" among all the white keys of the keyboard instrument shown in FIG. 1, of which FIG. 10A is a planar view and FIG. 10B is a side view;

FIG. 11A and FIG. 11B are diagrams showing black keys of the keyboard instrument shown in FIG. 1, of which FIG. 11A is a planar view and FIG. 11B is a side view;

DETAILED DESCRIPTION OF THE PREFERRED EMBODIMENTS

An embodiment of a keyboard instrument where the present invention has been applied will hereinafter be described with reference to FIG. 1 to FIG. 11B.

Figure 1:
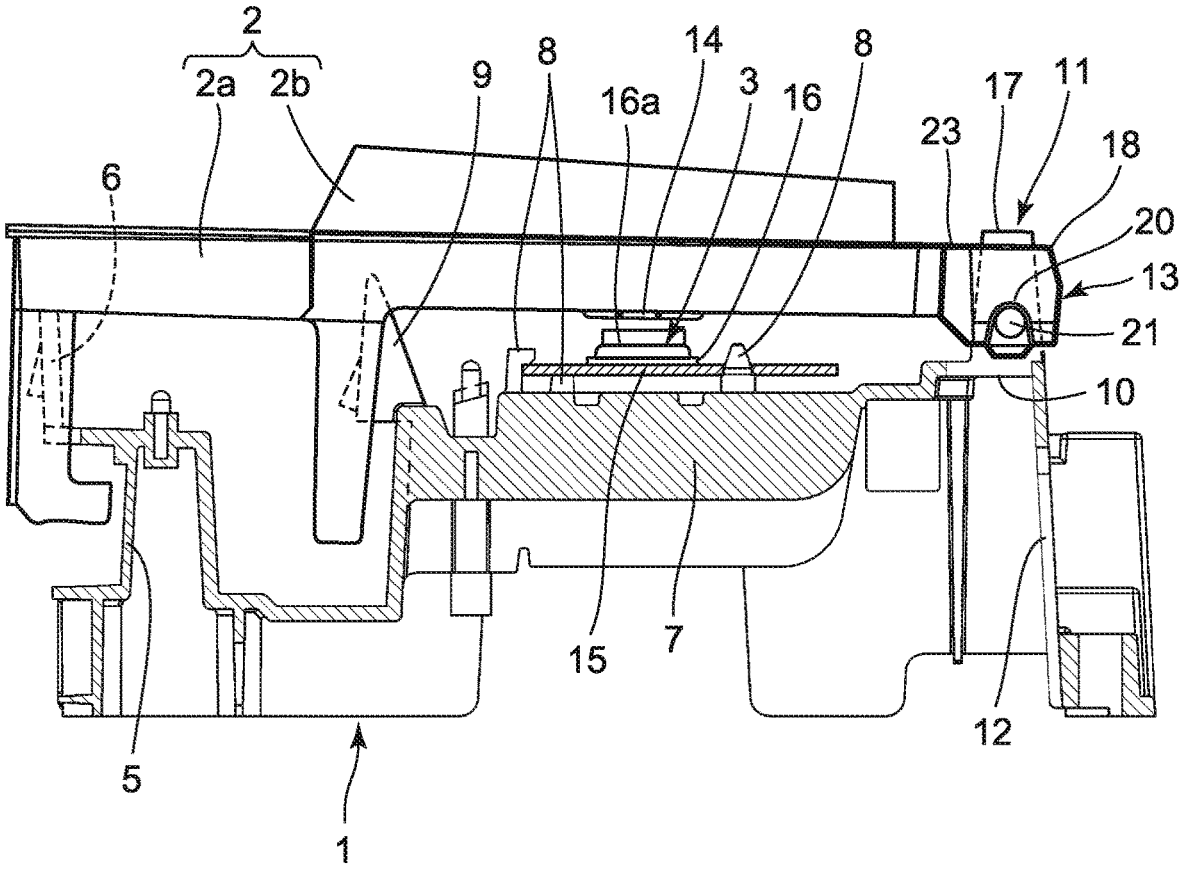
FIG. 1 is a cross-sectional view showing an embodiment of a keyboard instrument where the present invention has been applied.
Figure 2:
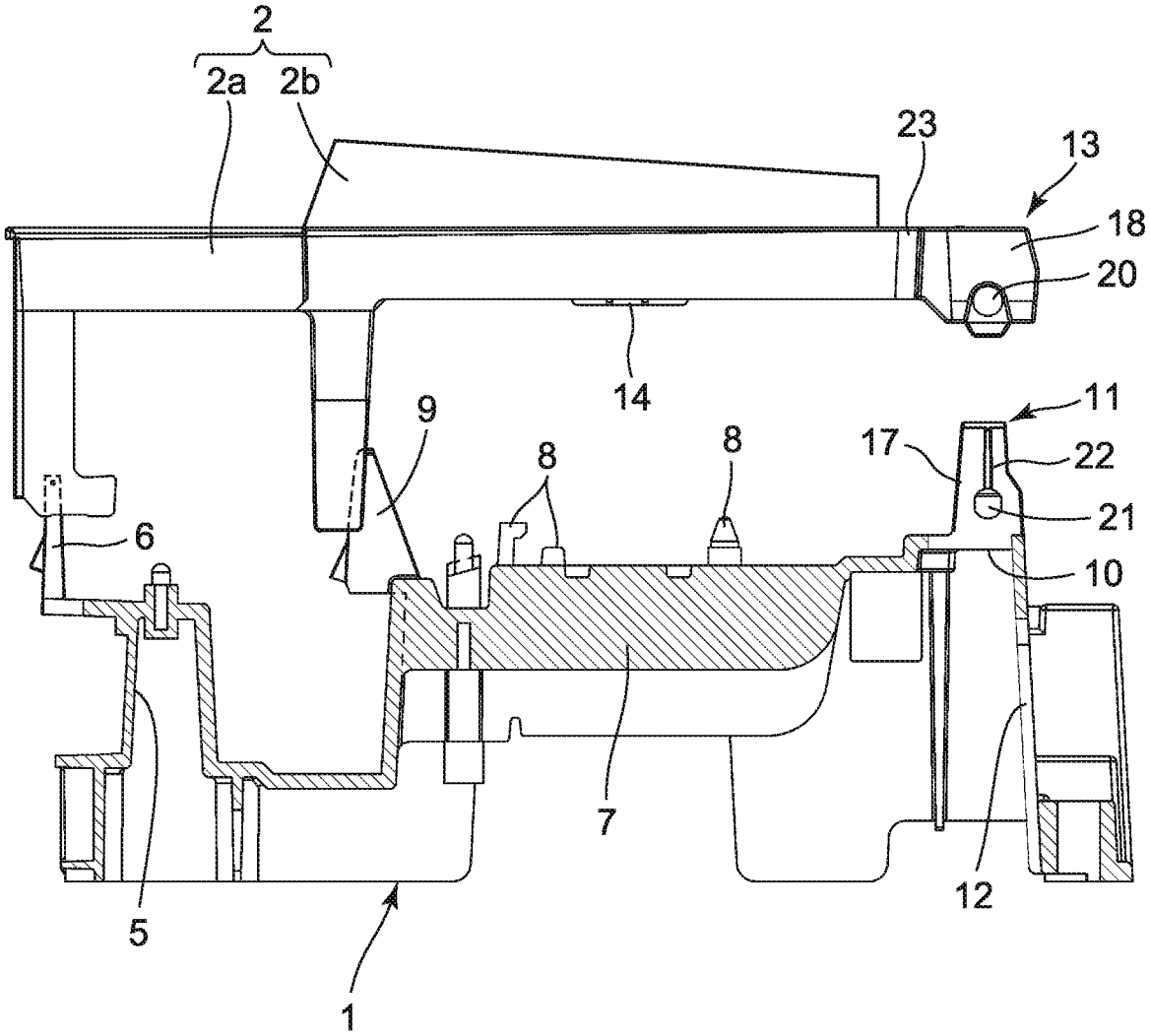
FIG. 2 is an exploded cross-sectional view showing a state where a key is mounted on a keyboard chassis of the keyboard instrument shown in FIG. 1.
Figure 3:
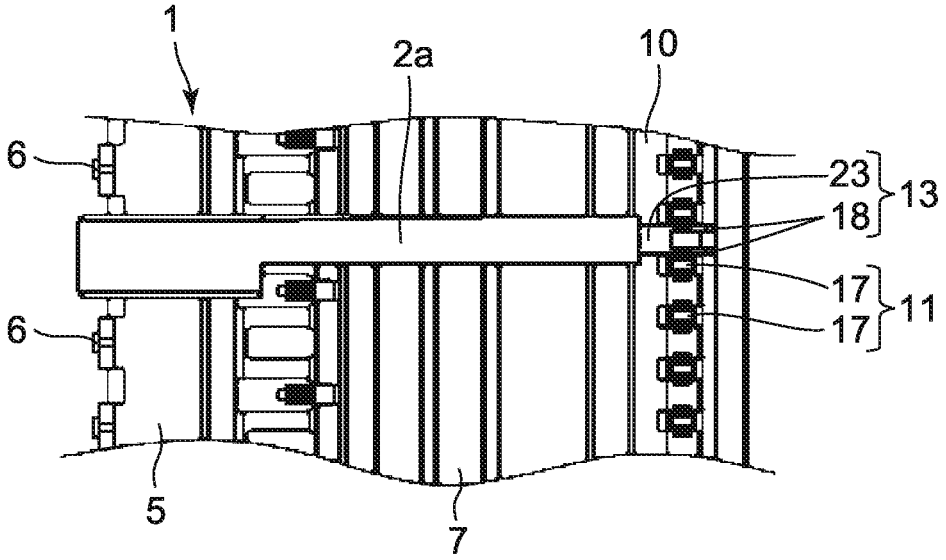
FIG. 3 is a planar view of a main part, in which one key has been mounted on the keyboard chassis of the keyboard instrument shown in FIG. 1.

This keyboard instrument is constituted by a keyboard chassis 1 made of synthetic resin such as ABS resin, a plurality of keys 2 which is arranged and mounted on the keyboard chassis 1 in a manner to be rotatable in a vertical direction, and a plurality of switch sections 3 which is turned on in response to key depression operations performed on the plurality of keys 2, as shown in FIG. 1 and FIG. 2. The plurality of keys 2 is constituted by a plurality of white keys 2*a* and a plurality of black keys 2*b*.

The keyboard chassis 1 is a member arranged in the musical instrument case (not shown). On the front end (left end in FIG. 1) of this keyboard chassis 1, a front leg section 5 is provided projecting upward from the bottom of the keyboard chassis 1, as shown in FIG. 1 and FIG. 2. On the upper part of the front leg section 5, a plurality of white key guiding sections 6 for preventing the horizontal displacement of each white key 2*a* is provided corresponding to these white keys 2*a*.

Also, in a substantially middle area of the keyboard chassis 1 in the front-rear direction (horizontal direction in FIG. 1), a board mounting section 7 is provided projecting at substantially the same height as that of the front leg section 5, as shown in FIG. 1 and FIG. 2. On this board mounting section 7, the switch sections 3 are attached by a plurality of board supporting sections 8. Moreover, on the front end (left end in FIG. 1) of the board mounting section 7, a plurality of black key guiding sections 9 for preventing the horizontal displacement of each black key 2*b* is provided corresponding to these black keys 2*b*.

Also, on the rear part of the keyboard chassis 1, that is, on the rear side of the board mounting section 7, a key mounting section 10 is provided projecting at a position one step higher than the board mounting section 7, as shown in FIG. 1 and FIG. 2. On the upper surface of this key mounting section 10, a plurality of key supporting sections 11 for rotatably supporting the keys 2 is provided projecting upward, as shown in FIG. 1 to FIG. 5. In this keyboard chassis 1, on the rear end of the key mounting section 10, a rear leg section 12 for supporting the rear end of the keyboard chassis 1 is provided to downwardly extend from the upper part of the keyboard chassis 1 toward the bottom part.

On the rear end (right end in FIG. 1) of each key 2, an attachment section 13 is provided, whereby each key 2 is structured such that its attachment section 13 is supported by the corresponding key supporting section 11 on the key mounting section 10 of the keyboard chassis 1 in a manner to be rotatable in the vertical direction, as shown in FIG. 1 to FIG. 4 and FIG. 6A to FIG. 6C. The length of each white key 2*a* of the keys 2 in the front-rear direction is longer than that of each black key 2*b*, and the height of each black key 2*b* of the keys 2 is higher than that of each white key 2*a*. Other than the lengths and the heights, the white keys 2*a* and the black keys 2*b* have substantially the same structure.

Also, on a substantially middle portion of each key 2 in the front-rear direction (horizontal direction in FIG. 1), a switch pressing section 14 for pressing the corresponding switch section 3 mounted on the board mounting section 7 of the keyboard chassis 1 is provided projecting downward, as shown in FIG. 1 and FIG. 2. The switch sections 3 have a structure where a rubber sheet 16 having dome-shaped bulging sections 16*a* arranged thereon is provided on the switch board 15.

The switch board 15 is formed in a band plate shape that is long in the array direction of the keys 2, as shown in FIG. 1. Both end sides of this switch board 15 in the front-rear direction are supported on the board mounting section 7 by a plurality of board supporting sections 8. The rubber sheet 16 is formed in a band plate shape that is long in the array direction of the keys 2 as with the switch board 15, and arranged on the switch board 15. Each dome-shaped bulging section 16*a* is provided by the rubber sheet 16 being partially bulged and thereby arrayed on the rubber sheet 16 with it opposing the switch pressing section 14 of the corresponding key 2.

Each switch section 3 is structured such that, when its bulging section 16*a* on the rubber sheet 16 is pressed by the corresponding switch pressing section 14, this bulging section 16*a* is elastically deformed, and a moving contact therein comes in contact with a fixed contact on the switch board 15, so that an ON signal is outputted, as shown in FIG. 1. On the switch board 15, a sound emission section is provided which generates musical sound information based on an ON signal outputted from the above-described switch section 3 and emits a musical sound from a speaker based on the generated musical sound information (both the sound emission section and the speaker are not shown in the drawing).

Each of the plurality of key supporting sections 11 provided on the rear part of the keyboard chassis 1 includes a pair of key supporting pieces 17 which are opposing each other in the array direction of the keys 2, as shown in FIG. 1 to FIG. 5. Each pair of key supporting pieces 17 corresponds to one of the plurality of keys 2, and is provided side by side in the array direction of the keys 2 with them standing upright on the key mounting section 10 on the keyboard chassis 1.

Also, each of the attachment sections 13 provided on the rear parts of the keys 2 includes a pair of attachment pieces 18 which are opposing each other in the array direction of the keys 2, as shown in FIG. 1 to FIG. 4, FIG. 6 and FIG. 7. Each pair of attachment pieces 18 is structured to be flexurally deformed in directions approaching or moving away from each other, and held between the corresponding pair of key supporting pieces 17 on the keyboard chassis 1 with their resilience being maintained.

In lower portions of each pair of attachment pieces 18, shaft holes 20 are provided on the same axis, as shown in FIG. 1, FIG. 2 and FIG. 4. Also, on lower portions of the opposing surfaces of each pair of key supporting pieces 17, shaft sections 21 that are rotatably inserted into the shaft holes 20 of the corresponding pair of attachment pieces 18 are provided on the same axis.

Figure 4A:
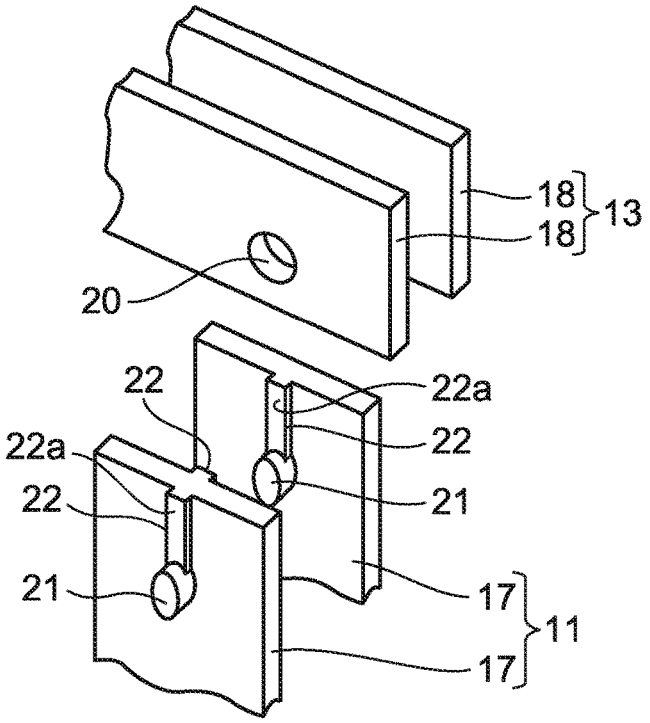
Figure 4B:
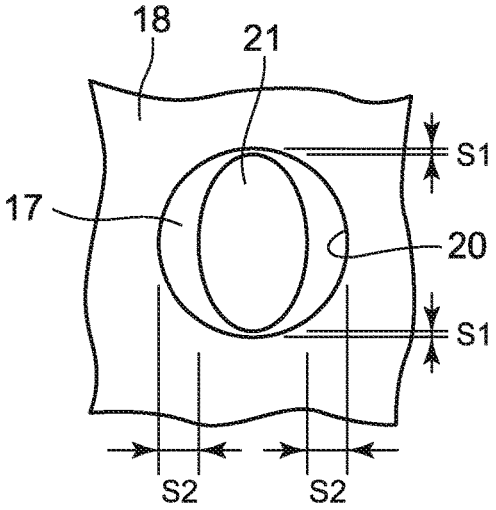
Figure 5:
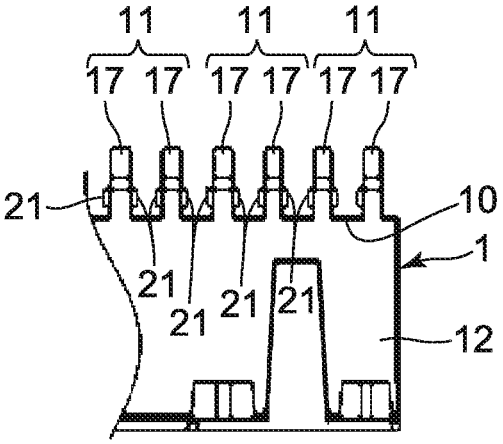
FIG. 5 is a rear view of the main part, in which key supporting sections of the keyboard chassis in FIG. 2 are shown.
Figure 6A:
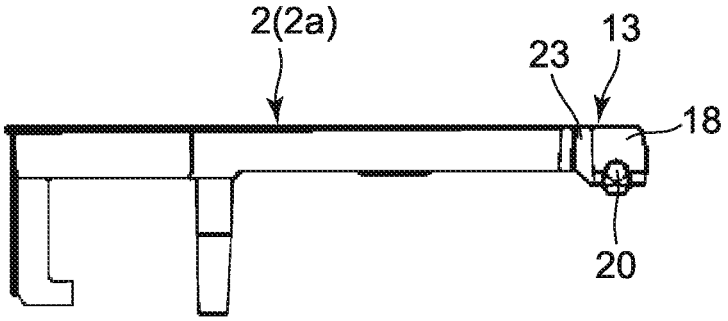
Figure 6B:
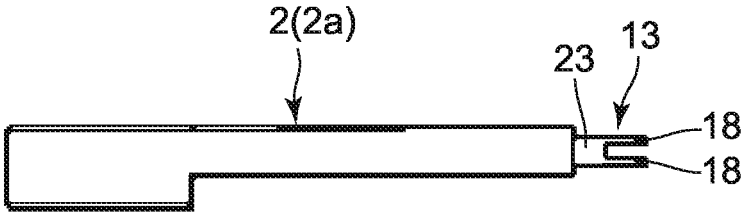
Figure 6C:
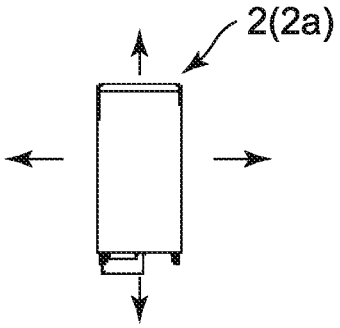

The shaft holes 20 and the shaft sections 21 are structured such that first and second spaces S1 and S2 are ensured between the inner circumference surface of each shaft hole 20 and the outer circumference surface of the corresponding shaft section 21 when the shaft sections 21 are inserted into the shaft holes 20, as shown in FIG. 4A and FIG. 4B. The first spaces S1 are small spaces that are formed between the inner circumference surface of each shaft hole 20 and the outer circumference surface of the corresponding shaft section 21 in the vertical direction of the corresponding key 2 when this key 2 is not in a depressed state.

That is, each first space S1 is a small space when each shaft section 21 is rotatably fitted into the corresponding shaft hole 20, which is within the range of a fitting tolerance, as shown in FIG. 4A and FIG. 4B. The second spaces S2 are spaces that are formed between the inner circumference surface of each shaft hole 20 and the outer circumference surface of the corresponding shaft section 21 in the front-rear direction (longitudinal direction) of the corresponding key 2 when this key 2 is not in a depressed state. Each of these second spaces S2 is sufficiently larger than the above-described fitting tolerance, and is larger than each first space S1.

Here, the shaft holes 20 of each pair of attachment pieces 18 are each formed in an exact circular shape, and the shaft sections 21 of each pair of key supporting pieces 17 are formed such that the cross-sectional shape of each shaft section 21 is oval and long in the vertical direction, as shown in FIG. 4B. That is, the outer diameter of each oval shaft section 21 in the vertical direction is slightly shorter than the inner diameter of the corresponding shaft hole 20, or in other words, shorter than the inner diameter of the corresponding shaft hole 20 by a length equal to space within the range of the above-described fitting tolerance, whereby each first space S1 is formed.

Also, the outer diameter of each oval shaft section 21 in the front-rear direction which is the longitudinal direction of each key 2 is sufficiently shorter than the inner diameter of each shaft hole 20, or in other words, short enough to have space that is sufficiently larger than the above-described fitting tolerance, whereby each second space S2 is formed, as shown in FIG. 4B. For this reason, each second space S2 is larger than each first space S1.

Figure 7:
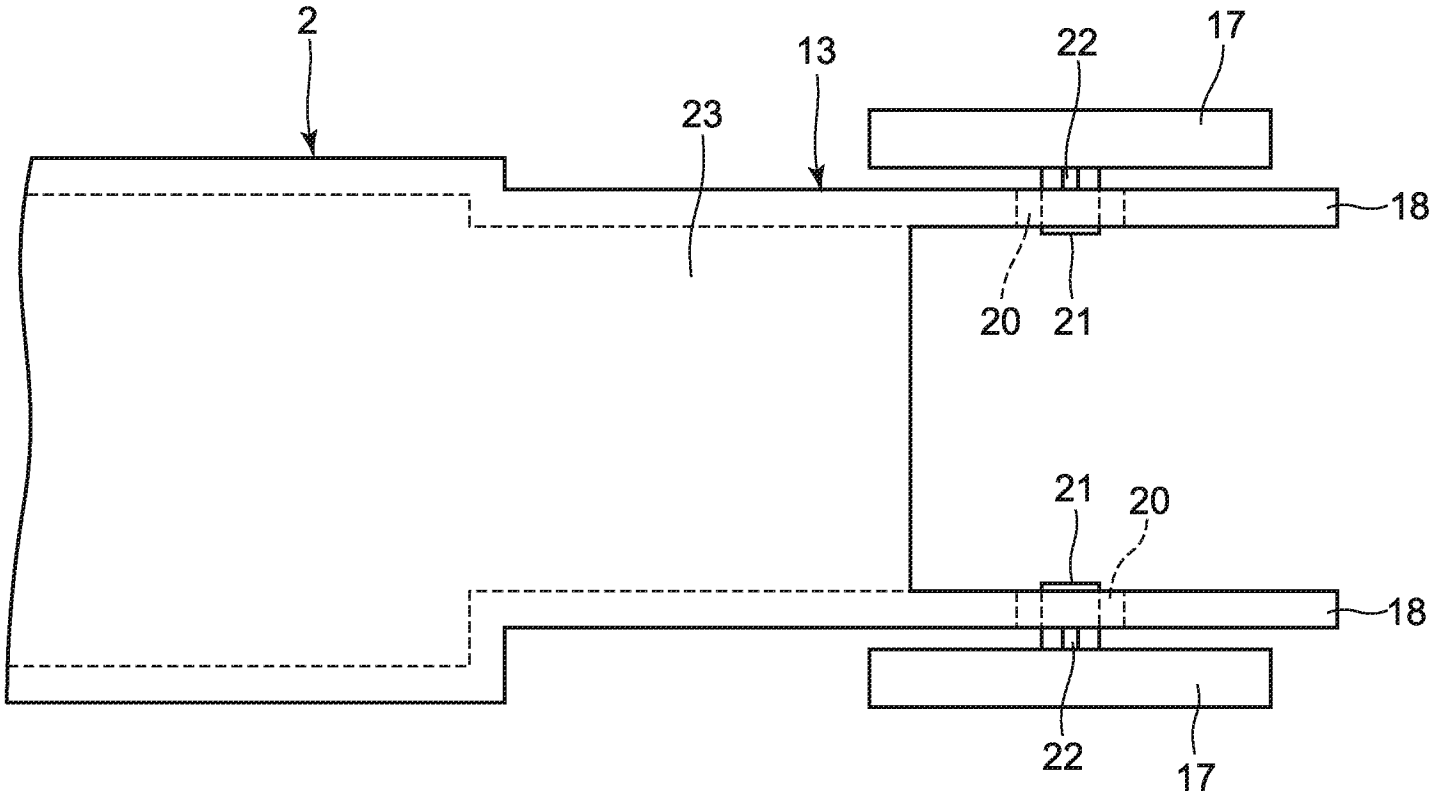
FIG. 7 is an enlarged planar view of the main portion showing a state where a pair of attachment pieces of an attachment section of the key shown in FIG. 3 has been arranged between a pair of key supporting pieces of a key supporting section of the keyboard chassis and shaft sections have been inserted into shaft holes.
Figure 8:
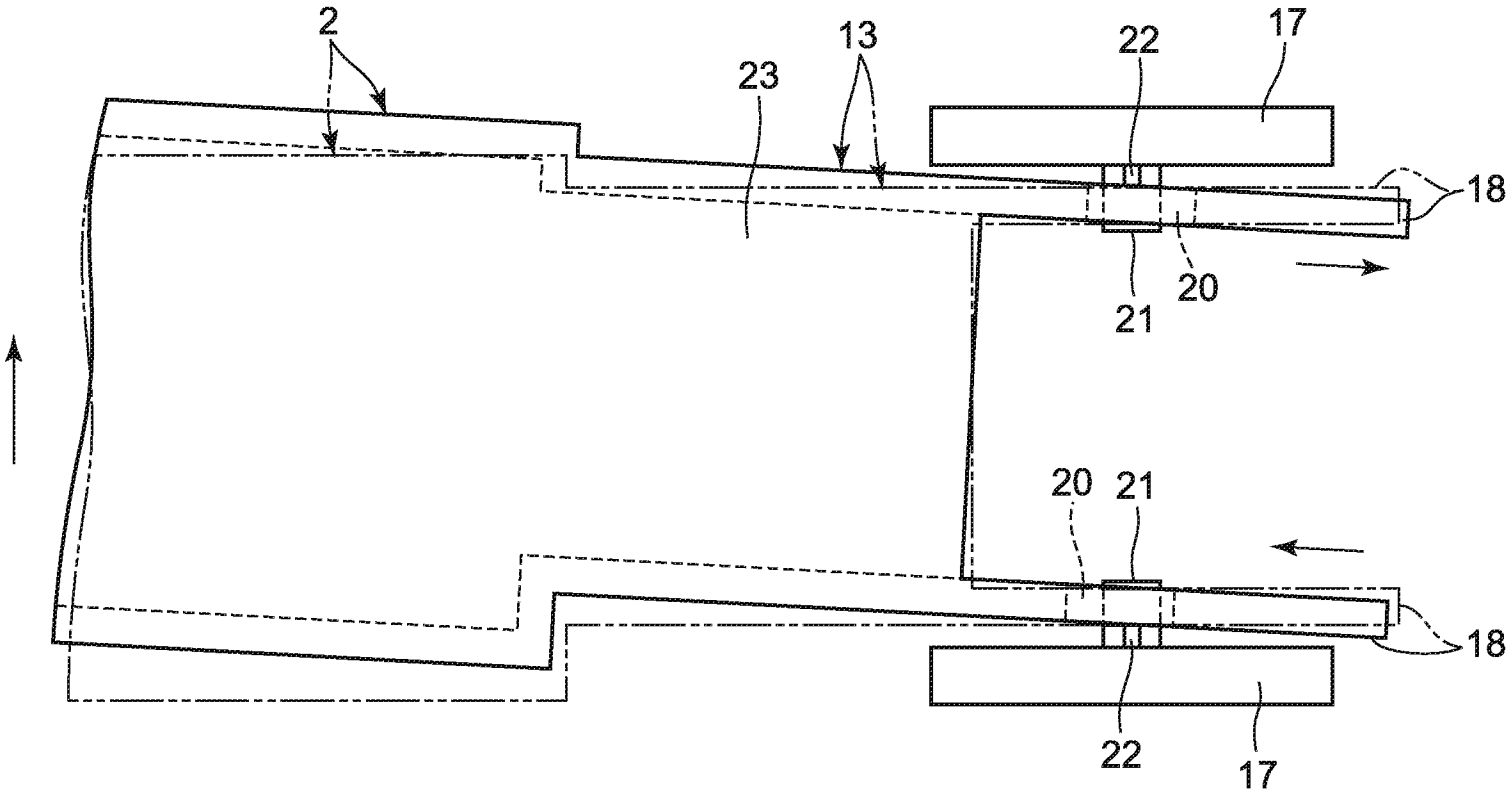
FIG. 8 is an enlarged planar view of the main portion showing a state where the front end of the key shown in FIG. 7 has been displaced in the array direction of the keys.

As a result, when the pair of attachment pieces 18 of a key 2 is held between the corresponding pair of key supporting pieces 17 on the keyboard chassis 1 and the shaft sections 21 of the pair of key supporting pieces 17 are rotatably inserted into the shaft holes 20 and held between the pair of key supporting pieces 17, the first and second spaces S1 and S2 are formed between the inner circumference surface of each shaft hole 20 and the outer circumference surface of the corresponding shaft section 21, so that a space between the front end of the key 2 and the front end of an adjacent key 2 can be adjusted by the front end of the key 2 being displaced in the array direction (horizontal direction) of the keys 2, as shown in FIG. 7 and FIG. 8.

That is, in a state where a key 2 has been rotatably held by the corresponding pair of key supporting pieces 17 by the shaft sections 21 of the pair of key supporting pieces 17 being inserted into the shaft holes 20 of the pair of the attachment pieces 18 of the key 2 as shown in FIG. 7, when one of the pair of attachment pieces 18 on the left side in the array direction of the keys 2 is shifted rearward within the range of the corresponding second spaces S2 and the other one of the pair of attachment pieces 18 on the right side in the array direction of the keys 2 is shifted frontward within the range of the corresponding second spaces S2 as shown by the solid line in FIG. 8, the front end of the key 2 is displaced leftward in the array direction of the keys 2, whereby a space between the front end of the key 2 and the front end of an adjacent key 2 is adjusted.

Also, in the state where the key 2 has been rotatably held by the corresponding pair of key supporting pieces 17 by the shaft sections 21 of the pair of key supporting pieces 17 being inserted into the shaft holes 20 of the pair of the attachment pieces 18 of the key 2 as shown in FIG. 7, when one of the pair of attachment pieces 18 on the left side in the array direction of the keys 2 is shifted frontward within the range of the corresponding second spaces S2 and the other one of the pair of attachment pieces 18 on the right side in the array direction of the keys 2 is shifted rearward within the range of the corresponding second spaces S2, the front end of the key 2 is displaced rightward in the array direction of the keys 2, whereby a space between the front end of the key 2 and the front end of an adjacent key 2 is adjusted.

Also, on the opposing surfaces of each pair of key supporting pieces 17 on the keyboard chassis 1, pressing ribs 22 for pressing and holding therebetween the pair of attachment pieces 18 of the corresponding key 2 are provided extending vertically above the shaft sections 21, as shown in FIG. 2 and FIG. 4A. The projecting lengths (thicknesses) of these pressing ribs 22 from the opposing surfaces of the corresponding pair of key supporting pieces 17 (thickness) are shorter than the projecting lengths of the shaft sections 21 projecting from the opposing surfaces, that is, the lengths of the shaft sections 21 in the axial direction. Each of these pressing ribs 22 is provided on a straight line passing through the center of the corresponding shaft section 21.

As a result, each key 2 is structured such that, when its pair of attachment pieces 18 is arranged between the corresponding pair of key supporting pieces 17 on the keyboard chassis 1 and the shaft sections 21 projecting more than the pressing ribs 22 on the opposing surfaces of the pair of key supporting pieces 17 are rotatably inserted into the shaft holes 20 of the pair of attachment pieces 18, the pair of attachment pieces 18 is held between the pressing ribs 22, as shown in FIG. 1, FIG. 2 and FIG. 4B.

That is, the pressing surface 22*a* of each pressing rib 22 which is pressed against the outer surface of one of the attachment pieces 18 of the corresponding key 2 is perpendicular to the upper surface of the key mounting section 10 of the keyboard chassis 1 which is a horizontal surface, as shown in FIG. 4A. That is, no draft is provided on this pressing surface 22*a*. Accordingly, when the outer surfaces of each pair of attachment pieces 18 are pressed against the corresponding pressing surfaces 22*a*, each outer surface is pressed against the entire area of the corresponding pressing surface 22*a* equally. As a result, by the pressing ribs 22, the keys 2 are prevented from being moved in directions other than the vertical and horizontal directions.

Also, the length of each pressing rib 22 in the front-rear direction of the keys 2 is shorter than the length of the corresponding shaft section 21, as shown in FIG. 2 and FIG. 4A. As a result, even when the pair of attachment pieces 18 of a key 2 is pressed and held between the corresponding pressing ribs 22, the front end of the key 2 can be displaced in the array direction (horizontal direction) of the keys 2 with one of the pressing ribs 22 as a fulcrum.

Also, the attachment section 13 of each key 2 is provided with a deformation restriction section 23 which restricts the flexural deformation of the corresponding pair of attachment pieces 18 in the directions approaching or moving away from each other, as shown in FIG. 3, and FIG. 6 to FIG. 8. Each deformation restriction section 23 is provided between upper end portions of the bases of the pair of attachment pieces 18 of the corresponding key 2.

As a result, each deformation restriction section 23 functions to minimize the flexural deformation of the corresponding pair of attachment pieces 18 in the directions approaching each other when the pair of attachment pieces 18 is held between the corresponding pair of key supporting pieces 17 on the keyboard chassis 1 or is removed therefrom, as shown in FIG. 7 and FIG. 8.

That is, each deformation restriction section 23 is provided such that its rear end is located at a position between portions of the corresponding pair of key supporting pieces 17, that is, a position corresponding to front portions of the corresponding pair of key supporting pieces 17, as shown in FIG. 7 and FIG. 8. As a result, each deformation restriction section 23 is structured such that greater deformation force is required when the corresponding pair of attachment pieces 18 is flexurally deformed in the directions approaching each other.

Here, the length of each deformation restriction section 23 in the front-rear direction should preferably be structured to be a suitable length in accordance with the thicknesses of the corresponding pair of attachment pieces 18, that is, the lengths (widths) of the attachment pieces 18 in the array direction of the keys 2, as shown in FIG. 7 and FIG. 8. That is, each deformation restriction section 23 should preferably be structured such that its length in the front-rear direction is short in a structure where each corresponding attachment piece 18 is thick, and is longer in a structure where each corresponding attachment piece 18 is thin.

Also, the upper parts of each pair of key supporting pieces 17 on the keyboard chassis 1 project higher than the upper parts of the corresponding pair of attachment pieces 18 attached to this pair of key supporting pieces 17, as shown in FIG. 1 to FIG. 5. That is, the upper ends of each pair of key supporting pieces 17 are structured to project higher than the upward rotation ranges of the upper parts of the corresponding pair of attachment pieces 18. As a result, the rotation of each key 2 in the vertical direction is not blocked even when a component (not shown) such as a substrate is arranged on the pairs of key supporting pieces 17.

Next, the mechanism of this keyboard instrument according to the present invention is described.

In the assembly of the keyboard instrument of the present embodiment, the plurality of keys 2 is manufactured in advance. These keys 2 are acquired by first white key blocks 25, second white key blocks 26, and black key blocks 27 being individually manufactured and then combined, as shown in FIG. 9A to FIG. 11B.

Figure 9A:
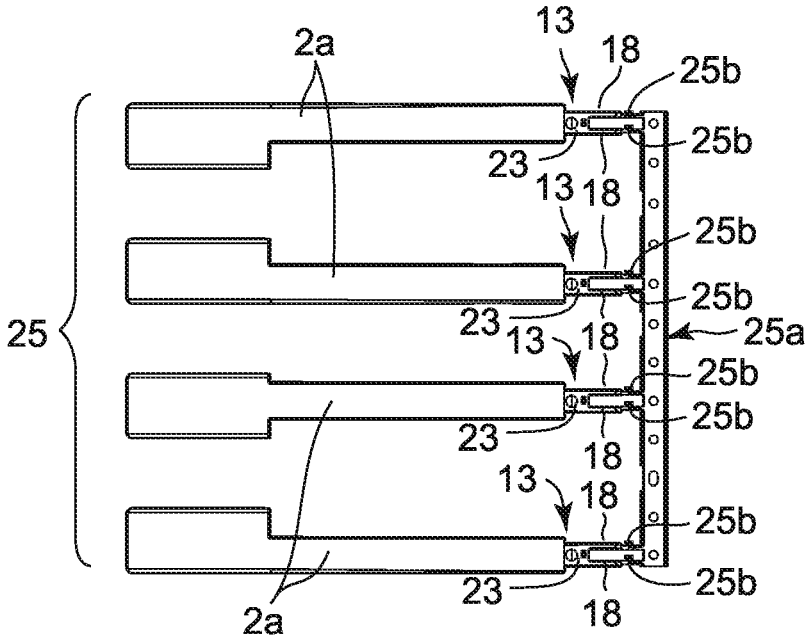
Figure 9B:
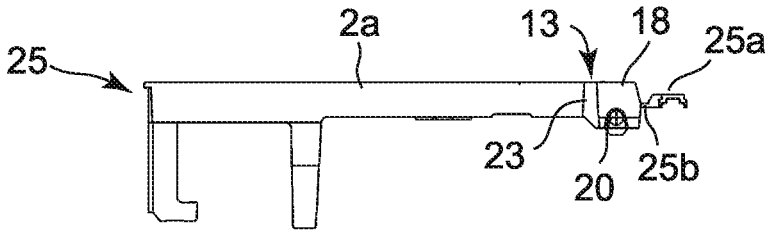

More specifically, in each first white key block 25, white keys 2*a* corresponding to the notes C, E, G and B have been integrally formed by being connected using a first connection runner section 25*a*, as shown in FIG. 9A and FIG. 9B. This first connection runner section 25*a* is formed having a belt-like shape extending in the array direction of the white keys 2*a* and positioned behind these white keys 2*a* corresponding to the notes C, E, G and B. Also, this first connection runner section 25*a* is provided with a plurality of first gate sections 25*b* connecting to the rear ends of the pairs of attachment pieces 18 of the white keys 2*a* corresponding to the notes C, E, G and B.

Each first white key block 25 is molded by a first molding die (not shown). In this process, resin is injected into a molding space for the first connection runner section 25*a* in the first molding die, and then injected into molding spaces for the white keys 2*a* corresponding to the notes C, E, G and B from molding spaces for the plurality of first gate sections 25*b*. As a result, a first white key block 25 is integrally formed in which the white keys 2*a* corresponding to the notes C, E, G and B have been connected to one another by the first connection runner section 25*a* and the plurality of first gate sections 25*b*, as shown in FIG. 9A and FIG. 9B.

Figure 10A:
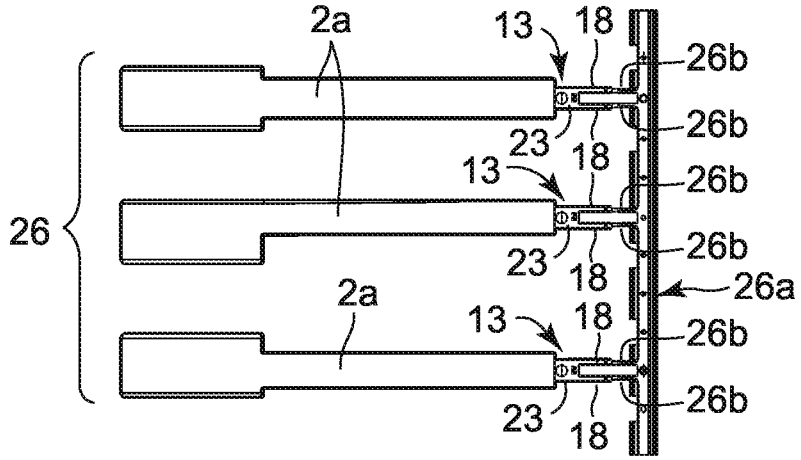
Figure 10B:
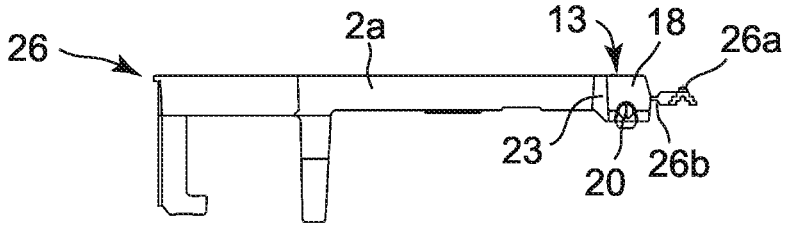

Also, in each second white key block 26, white keys 2*a* corresponding to the notes D, F and A have been integrally formed by being connected using a second connection runner section 26*a*, as shown in FIG. 10A and FIG. 10B. This second connection runner section 26*a* is formed having a belt-like shape extending in the array direction of the white keys 2*a* and positioned behind these white keys 2*a* corresponding to the notes D, F and A. Also, this second connection runner section 26*a* is provided with a plurality of second gate sections 26*b* connecting to the rear ends of the pairs of attachment pieces 18 of the white keys 2*a* corresponding to the notes D, F and A.

Each second white key block 26 is molded by a second molding die (not shown). In this process, resin is injected into a molding space for the second connection runner section 26*a* in the second molding die, and then injected into molding spaces for the white keys 2*a* corresponding to the notes D, F and A from molding spaces for the plurality of second gate sections 26*b*. As a result, a second white key block 26 is integrally formed in which the white keys 2*a* corresponding to the notes D, F and A have been connected to one another by the second connection runner section 26*a* and the plurality of second gate sections 26*b*, as shown in FIG. 10A and FIG. 10B.

Figure 11A:
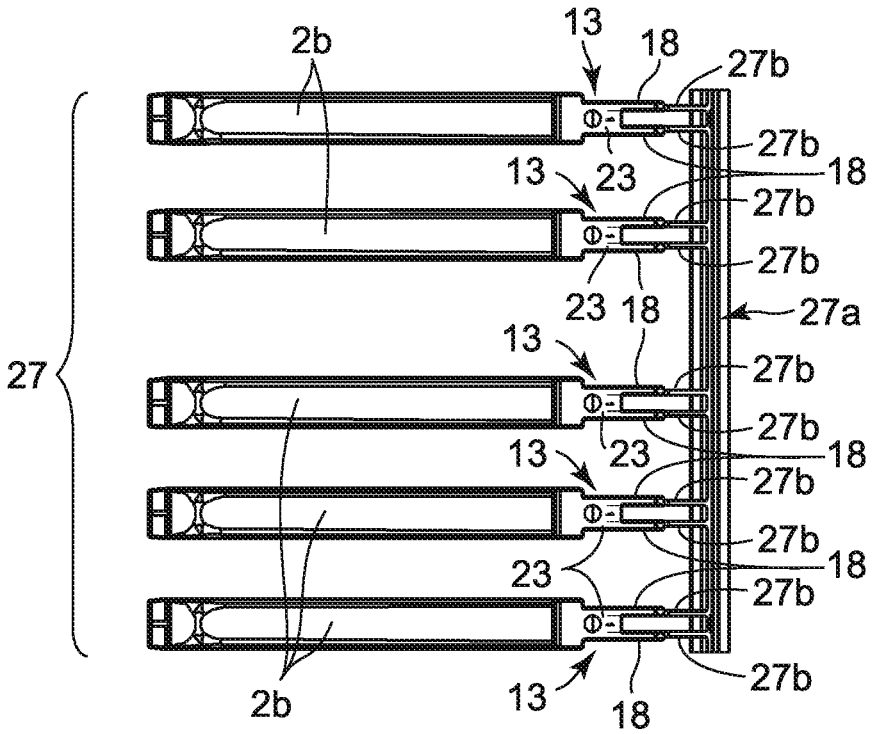
Figure 11B:
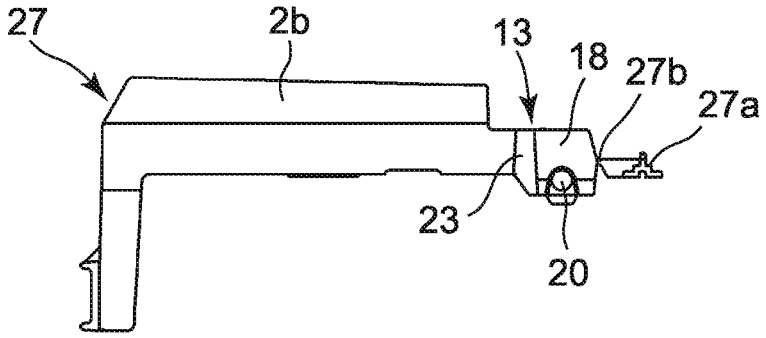

Also, in each black key block 27, a plurality of black keys 2*b* has been integrally formed by being connected using a third connection runner section 27*a*, as shown in FIG. 11A and FIG. 11B. This third connection runner section 27*a* is formed having a belt-like shape extending in the array direction of the black keys 2*b* and positioned behind these black keys 2*b*. Also, this third connection runner section 27*a* is provided with a plurality of third gate sections 27*b* connecting to the rear ends of the pairs of attachment pieces 18 of the black keys 2*b*.

Each black key block 27 is molded by a third molding die (not shown). In this process, resin is injected into a molding space for the third connection runner section 27*a* in the third molding die, and then injected into molding spaces for the plurality of black keys 2*b* from molding spaces for the plurality of third gate sections 27*b*. As a result, a black key block 27 is integrally formed in which the black keys 2*b* have been connected to one another by the third connection runner section 27*a* and the plurality of third gate sections 27*b*, as shown in FIG. 11A and FIG. 11B.

The white keys 2*a* of each first white key block 25, the white keys 2*a* of each second white key block 26, and the black keys 2*b* of each black key block 27 formed as described above are mounted on the keyboard chassis 1 as follows. First, the first connection runner section 25*a*, the second connection runner section 26*a*, and the third connection runner section 27*a* are arranged one on top of another such that each white key 2*a* of the first white key block 25 corresponding to the notes C, E, G and B, each white key 2*a* of the second white key block 26 corresponding to the notes D, F and A, and each black key 2*b* of the black key block 27 are arranged between the corresponding keys, whereby these keys are arrayed as the plurality of keys 2.

That is, the second connection runner section 26*a* of the second white key block 26 is arranged under the first connection runner section 25*a* of the first white key block 25, so that each white key 2*a* of the first white key block 25 corresponding to the notes C, E, G and B and each white key 2*a* of the second white key block 26 corresponding to the notes D, F and A are alternately arranged. Then, the third connection runner section 27*a* of the black key block 27 is arranged under the second connection runner section 26*a* of the second white key block 26, so that each black key 2*b* of the black key block 27 is arranged between the corresponding one of the white keys 2*a* of the first white key block 25 related to the notes C, E, G and B and the corresponding one of the white keys 2*a* of the second white key block 26 related to the notes D, F and A.

As a result, the white keys 2*a* of the first white key block 25, the white keys 2*a* of the second white key block 26, and the black keys 2*b* of the black key block 27 are arrayed in musical scale order, that is, the keys 2 for one octave are arrayed. Then, the keys 2 in this state are mounted on the keyboard chassis 1. Here, before the mounting of the keys 2, the switch sections 3 are mounted on the board mounting section 7 of the keyboard chassis 1. First, the rubber sheet 16 having arranged thereon the dome-shaped bulging sections 16*a* of the switch sections 3 is arranged on the switch board 15, and then the switchboard 15 having the rubber sheet 16 arranged thereon is attached to the board mounting section 7 via the plurality of board supporting sections 8.

In this state, the plurality of keys 2 is mounted on the keyboard chassis 1. Here, the white key guiding sections 6 of the keyboard chassis 1 are inserted into the front parts of the plurality of white keys 2*a* and the black key guiding sections 9 of the keyboard chassis 1 are inserted into the front parts of the plurality of black keys 2*b*, so that the switch pressing sections 14 of the plurality of keys 2 correspond to the bulging sections 16*a* of the switch sections 3. In this state, each pair of attachment pieces 18 provided on the rear parts of the keys 2 is inserted from above between the corresponding pair of key supporting pieces 17 provided on the rear part of the keyboard chassis 1.

Here, the outer side surfaces of the pair of attachment pieces 18 of each key 2 are pressed against the pressing surfaces 22*a* of the pressing ribs 22 on the opposing surfaces of the corresponding pair of key supporting pieces 17, whereby the pair of attachment pieces 18 is flexurally deformed in the directions approaching each other against the deformation restriction force of the corresponding deformation restriction section 23, and inserted between the pair of key supporting pieces 17. Subsequently, the shaft sections 21 provided on the lower parts of each pair of key supporting pieces 17 are inserted into the shaft holes 20 in the lower parts of the corresponding pair of attachment pieces 18.

Here, since the projection lengths (thicknesses) of the pressing ribs 22 projecting from the opposing surfaces of each pair of key supporting pieces 17 are shorter (thinner) than the projection lengths of the shaft sections 21 projecting from the opposing surfaces of each pair of key supporting pieces 17, the shaft sections 21 project more than the pressing ribs 22 on the opposing surfaces of each pair of key supporting pieces 17. Accordingly, when the projecting shaft sections 21 of each pair of key supporting pieces 17 are to be inserted into the shaft holes 20 of the corresponding pair of attachment pieces 18, the pair of attachment pieces 18 is further flexurally deformed in the directions approaching each other by the shaft sections 21, so that the shaft sections 21 are inserted into the shaft holes 20.

More specifically, when the shaft sections 21 are to be inserted into the shaft holes 20, the pair of attachment pieces 18 flexurally deformed in the directions approaching each other is resiliently returned in the directions moving away from each other, so that the shaft sections 21 are unfailingly inserted into the shaft holes 20. When the shaft sections 21 are inserted into the shaft holes 20 as described above, the flexural deformation of the pair of attachment pieces 18 is restricted by the corresponding deformation restriction section 23 with the pair of attachment pieces 18 being held between the pressing ribs 22 provided on the opposing surfaces of the pair of key supporting pieces 17 and its resilient force being maintained, so that the pair of attachment pieces 18 is unfailingly and favorably held.

Also, here, since the pressing surfaces 22*a* of the pressing ribs 22 pressed against the outer surfaces of the pair of attachment pieces 18 are perpendicular to the upper surface of the key mounting section 10 of the keyboard chassis 1 which is a horizontal surface, and no draft has been provided on the pressing surfaces 22*a*, the outer surface of each attachment piece 18 is pressed against the entire area of the pressing surface 22*a* of the corresponding pressing rib 22 equally.

Accordingly, the outer surfaces of the pair of attachment pieces 18 are unfailingly and favorably supported by the pressing ribs 22 so that the corresponding key 2 is not moved in directions other than the vertical and horizontal directions with the shaft sections 21 of the pair of key supporting pieces 17 as a fulcrum. As a result, this key 2 is held in a manner to be rotatable in the vertical direction with the shaft sections 21 of the pair of key supporting pieces 17 as a fulcrum, in the state where the pair of attachment pieces 18 of the key 2 has been held between the pair of key supporting pieces 17 on the keyboard chassis 1 with its resilient force being maintained.

That is, the pair of attachment pieces 18 and the pressing ribs 22 allow the movement of the key 2 in the vertical direction (a direction in which the key 2 is moved by a key depression or release operation) and the horizontal direction (a direction in which the key 2 is moved by an operation of adjusting a space between keys) while restricting the movement of the key 2 in directions other than these directions (which are referred to as "inclination directions" herein for convenience of description).

Next, in the state where each shaft section 21 on the keyboard chassis 1 side is in the corresponding shaft hole 20 on the key 2 side, the first gate sections 25*b* of each first white key block 25, the second gate sections 26*b* of each second white key block 26, and the third gate sections 27*b* of each black key block 27 are cut at the rear ends of the pair of attachment pieces 18 of each key 2, whereby the first to third connection runner sections 25*a* to 27*a* and the first to third gate sections 25*b* to 27*b* are separated from the keys 2. As a result, the plurality of keys 2 are mounted on the keyboard chassis 1 at once.

In the above-described separation operation for the keys 2, notch sections (not shown) may be formed in advance in the first to third gate sections 25*b* to 27*b* on the rear ends of the pairs of attachment pieces 18 of the plurality of keys 2, and the first to third gate sections 25*b* to 27*b* may be separated using these notch sections when the pair of attachment pieces of each key 2 is inserted from above between the corresponding pair of key supporting pieces 17 provided on the rear part of the keyboard chassis 1.

That is, by the notch sections being provided, when the pair of attachment pieces 18 of each key 2 is inserted from above between the corresponding pair of key supporting pieces 17 on the rear part of the keyboard chassis 1 so as to insert the shaft sections 21 of the pair of key supporting pieces 17 into the shaft holes 20 of the pair of attachment pieces 18, the first to third gate sections 25*b* to 27*b* are automatically separated from the rear ends of the pairs of attachment pieces 18 by each pair of attachment pieces 18 being flexurally deformed in the directions approaching each other.

After the plurality of keys 2 are mounted on the keyboard chassis 1 as described above, if the front ends of some keys 2 lean to one side in the array direction of the keys 2 and spaces between these front ends become uneven, these spaces between the front ends of the keys 2 are adjusted. Here, the shaft holes 20 of each pair of attachment pieces 18 have an exact circular shape, the shaft sections 21 of each pair of key supporting pieces 17 have an oval shape that is long in the vertical direction, and the first and second spaces S1 and S2 have been provided between the inner circumference surface of each shaft hole 20 and the outer circumference surface of the corresponding shaft section 21. Accordingly, by the use of these first and second spaces S1 and S2, the front ends of the above-described keys 2 are displaced in the array direction (horizontal direction) of the keys 2, whereby the spaces therebetween are adjusted.

That is, in a state where a key 2 has been held by the shaft sections 21 of the corresponding pair of key supporting pieces 17 being rotatably inserted into the shaft holes 20 of the pair of the attachment pieces 18 of the key 2 as shown in FIG. 7, when one of the pair of attachment pieces 18 on the left side in the array direction of the keys 2 is shifted rearward within the range of the corresponding second spaces S2 and the other one of the pair of attachment pieces 18 on the right side in the array direction of the keys 2 is shifted frontward within the range of the corresponding second spaces S2 as shown by the solid line in FIG. 8, the front end of the key 2 is displaced leftward in the array direction of the keys 2, whereby a space between the front end of the key 2 and the front end of an adjacent key 2 is adjusted. By this operation being repeated, the above-described spaces between the front ends of the keys 2 can be aligned to be even.

Also, in the state where the key 2 has been held by the shaft sections 21 of the corresponding pair of key supporting pieces 17 being rotatably inserted into the shaft holes 20 of the pair of the attachment pieces 18 of the key 2 as shown in FIG. 7, when one of the pair of attachment pieces 18 on the left side in the array direction of the keys 2 is shifted frontward within the range of the corresponding second spaces S2 and the other one of the pair of attachment pieces 18 on the right side in the array direction of the keys 2 is shifted rearward within the range of the corresponding second spaces S2, the front end of the key 2 is displaced rightward in the array direction of the keys 2, whereby a space between the front end of the key 2 and the front end of an adjacent key 2 is adjusted. By this operation being repeated, the above-described spaces between the front ends of the keys 2 can be aligned to be even.

Here, since the length of each pressing rib 22 in the front-rear direction of the keys 2 is shorter than the length of each shaft section 21 in the front-rear direction, even when the pressing ribs 22 are pressing and holding the pair of attachment pieces 18 of the key 2 therebetween, the key 2 can be easily displaced in the array direction (horizontal direction) with one of the pressing ribs 22 as a fulcrum. By this structure as well, the above-described spaces between the front ends of the keys 2 can be easily adjusted by the front ends of the keys 2 being displaced in the array direction (horizontal direction).

Then, after the spaces between the front ends of the keys 2 are adjusted to be even, components (not shown) such as a substrate are arranged above the pairs of attachment pieces 18 located on the rear ends of the plurality of keys 2. As a result, the downsizing of the entire apparatus is achieved. Here, since the upper ends of the pairs of key supporting pieces 17 of the keyboard chassis 1 are projecting higher than the upper ends of the pairs of attachment pieces 18, even when components such as a substrate are arranged on the pairs of key supporting pieces 17 so as to achieve the downsizing of the entire apparatus, the rotation of each key 2 is not blocked. Accordingly, components such as a substrate can be favorably arranged.

When a musical performance is to be started using the keyboard instrument assembled as described above, the switch pressing sections 14 of the plurality of keys 2 have been pressed upward by the elastic force of the dome-shaped bulging sections 16*a* of the switch sections 3. In this state, when the front part of a key 2 is pressed from above, this key 2 is downwardly rotated with the shaft sections 21 of the corresponding pair of key supporting pieces 17, which are in the shaft holes 20 of the pair of attachment pieces 18 of the key 2, as a fulcrum.

Then, the switch pressing section 14 of the key 2 deforms the corresponding bulging section 16*a*, so that the moving contact therein comes in contact with the corresponding fixed contact on the switch board 15. As a result, the switch section 3 outputs an ON signal, the sound emission section generates musical sound information based on the ON signal, and the speaker emits a musical sound based on the generated musical sound information (both the sound emission section and the speaker are not shown in the drawing).

As described above, this keyboard instrument includes the keys 2 each of which has the shaft holes 20 in its attachment section 13, and the keyboard chassis 1 where the shaft sections 21 that are arranged in the shaft holes 20 of each key 2 have been provided on the key supporting sections 11, in which the first and second spaces S1 and S2 have been formed between the inner circumference surface of each shaft hole 20 and the outer circumference surface of the corresponding shaft section 21. In this keyboard instrument, each second space S2 located in the vertical direction of each key 2 is larger than each first space S1 located in the longitudinal direction of each key 2 when the keys 2 have not been pressed. Accordingly, by the front end of each key 2 being displaced in the array direction of the keys 2 by the use of the first and second spaces S1 and S2, spaces between the keys 2 can be arranged to be even.

That is, in a state where a shaft section 21 of a key supporting section 11 on the keyboard chassis 1 has been arranged and supported in a shaft hole 20 in an attachment section 13 of a key 2, since first and second spaces S1 and S2 are between the inner circumference surface of the shaft hole 20 and the outer circumference surface of the shaft section 21, the front end of the key 2 can be displaced in the array direction of the keys 2 by the use of the first and second spaces S1 and S2. As a result of this structure, spaces between the front ends of the keys 2 can be easily and favorably adjusted and aligned to be even.

Also, in this keyboard instrument, the attachment sections 13 of the keys 2 include the pairs of attachment pieces 18, the key supporting sections 11 of the keyboard chassis 1 include the pairs of key supporting pieces 17, the shaft holes 20 are provided in the pairs of attachment pieces 18, the shaft sections 21 are provided on the pairs of key supporting sections 11, and each pair of attachment pieces 18 is arranged between the corresponding pair of key supporting pieces 17. As a result of this structure, each pair of attachment pieces 18 can be held between the corresponding pair of key supporting pieces 17 with their resilience being maintained and, by the shaft sections 21 of each pair of key supporting pieces 17 being arranged in the pair of shaft holes 20 of the corresponding attachment piece 18 in this state, the keys 2 can be rotatably mounted on the keyboard chassis 1 favorably and unfailingly.

Moreover, the shaft holes 20, each of which has an exact circular shape, are provided in each pair of attachment pieces 18 such that they correspond to each other on the same axis, and the shaft sections 21, each of which has an oval outer shape that is long in the vertical direction, are provided on each pair of key supporting pieces 17 such that they correspond to each other on the same axis. Accordingly, in a state where the shaft sections 21 of the pairs of key supporting pieces 17 are in the shaft holes 20 of the pairs of attachment piece 18 and the keys 2 have not been pressed, the second spaces S2 located in each key 2 in the front-rear direction which is the longitudinal direction are larger than the first spaces S1 located in each key 2 in the vertical direction.

That is, each first space S1 is a small space when each shaft section 21 is rotatably fitted into the corresponding shaft hole 20, which is within the range of the average fitting tolerance. Also, the second spaces S2 are spaces that are formed between the inner circumference surface of each shaft hole 20 and the outer circumference surface of the corresponding shaft section 21 in the front-rear direction (longitudinal direction) of the corresponding key 2 when this key 2 is not in a depressed state, and each second space S2 is sufficiently larger than the above-described fitting tolerance. In addition, these second spaces S2 are larger than the first spaces S1. Accordingly, by the use of the first and second spaces S1 and S2, the front end of each key 2 can be unfailingly displaced in the array direction of the keys 2. As a result of this structure, spaces between the front ends of the plurality of keys 2 can be easily and favorably adjusted and aligned to be even.

More specifically, in this keyboard instrument, in a state where a key 2 has been supported by the shaft sections 21 of the corresponding pair of key supporting pieces 17 being arranged in the shaft holes 20 of the pair of the attachment pieces 18 of the key 2, when one of the pair of attachment pieces 18 on the left side (upper side in FIG. 8) in the array direction of the keys 2 is shifted rearward within the range of the corresponding second spaces S2 and the other one of the pair of attachment pieces 18 on the right side (lower side in FIG. 8) in the array direction of the keys 2 is shifted frontward within the range of the corresponding second spaces S2, the front end of the key 2 is displaced leftward (toward the upper side in FIG. 8) in the array direction of the keys 2, whereby a space between the front end of the key 2 and the front end of an adjacent key 2 can be easily and favorably adjusted. As a result of this structure, spaces between the keys 2 can be aligned to be even.

Also, in this keyboard instrument, in the state where the key 2 has been supported by the shaft sections 21 of the corresponding pair of key supporting pieces 17 being arranged in the shaft holes 20 of the pair of the attachment pieces 18 of the key 2, when one of the pair of attachment pieces 18 on the left side (upper side in FIG. 7) in the array direction of the keys 2 is shifted frontward within the range of the corresponding second spaces S2 and the other one of the pair of attachment pieces 18 on the right side (lower side in FIG. 7) in the array direction of the keys 2 is shifted rearward within the range of the corresponding second spaces S2, the front end of the key 2 is displaced rightward (toward the lower side in FIG. 7) in the array direction of the keys 2, whereby a space between the front end of the key 2 and the front end of an adjacent key 2 can be easily and favorably adjusted. As a result of this structure, spaces between the keys 2 can be aligned to be even.

Moreover, in this keyboard instrument, the pressing ribs 22 whose lengths (thicknesses) are shorter (thinner) than those of the shaft sections 21 in the axial direction are each provided on a straight line passing through the center of the corresponding shaft section 21. Accordingly, when a pair of attachment pieces 18 is arranged between a pair of key supporting pieces 17, this pair of attachment pieces 18 is unfailingly and favorably held therebetween by the pressing ribs 22 of the key supporting pieces 17 opposing each other.

Then, when the shaft sections 21 of this pair of key supporting pieces 17 are to be inserted into the shaft holes 20 of the pair of attachment pieces 18, since the shaft sections 21 are projecting more than the pressing ribs 22, the pair of attachment pieces 18 is flexurally deformed in the direction approaching each other, and then resiliently returned in the direction moving away from each other, whereby the shaft sections 21 are inserted into the shaft holes 20.

Here, since the pressing surfaces 22*a* of the pressing ribs 22 pressed against the outer surfaces of the pair of attachment pieces 18 are perpendicular to the upper surface of the key mounting section 10 of the keyboard chassis 1 which is a horizontal surface, that is, since no draft has been provided on the pressing surfaces 22*a*, the outer surface of each attachment piece 18 is pressed against the entire area of the pressing surface 22*a* of the corresponding pressing rib 22 equally.

As a result of this structure, in this keyboard instrument, the outer surfaces of each pair of attachment pieces 18 can be unfailingly and favorably supported by the corresponding pressing ribs 22. That is, each pair of attachment pieces 18 can be held between the corresponding pair of key supporting pieces 17 with their resilience being maintained such that the corresponding key 2 is not moved in directions other than the vertical and horizontal directions with the shaft sections 21 as a fulcrum. As a result of this structure, the keys 2 can be unfailingly and favorably held.

Also, since the length of each pressing rib 22 in the front-rear direction of the keys 2 is shorter than the length of each shaft section 21 in the front-rear direction, even when the pair of attachment pieces 18 of each key 2 is pressed and held between the corresponding pressing ribs 22, each key 2 can be easily displaced in the array direction (horizontal direction) with one of the pressing ribs 22 as a fulcrum. By this structure as well, the front ends of the plurality of keys 2 can be easily displaced in the array direction, so that spaces therebetween can be easily adjusted.

Also, in this keyboard instrument, the attachment sections 13 include the deformation restriction sections 23 each of which restricts the deformation of the corresponding pair of attachment pieces 18. Accordingly, by each deformation restriction section 23, the flexural deformation of the corresponding pair of attachment pieces 18 in the directions approaching each other can be reduced to a bare minimum when the pair of attachment pieces 18 is held between the corresponding pair of key supporting pieces 17 on the keyboard chassis 1 or is removed therefrom. As a result of this structure, each pair of attachment pieces 18 can be unfailingly and favorably interposed and held between the corresponding pair of key supporting pieces 17 on the keyboard chassis 1.

Moreover, each deformation restriction section 23 is provided extending on the upper front surfaces of the corresponding pair of attachment pieces 18. That is, the upper surface of the rear end of each key 2 forms a U shape by the corresponding deformation restriction section 23 and the corresponding pair of attachment pieces 18, and the rear end of each key 2 is inserted between the corresponding pair of key supporting pieces 17 by being resiliently deformed.

Furthermore, each deformation restriction section 23 is provided such that its rear end is located at a position between portions of the corresponding pair of key supporting pieces 17, that is, a position corresponding to front portions of the corresponding pair of key supporting pieces 17. By these deformation restriction sections 23 restricting the deformations of the rear ends of the keys 2, each key 2 is displaced in the vertical direction without wobbling in the horizontal direction and the inclination directions, so that the instrument player can perform a musical performance favorably.

That is, the lengths of the deformation restriction sections 23 in the front-rear direction have been structured to be optimal lengths in accordance with the thicknesses of the pairs of attachment pieces 18, that is, the lengths (width) of the attachment pieces 18 in the array direction of the keys 2, so that the deformation force of the flexural deformation of each pair of attachment pieces 18 in the directions approaching each other can be optimized. As a result of this structure, each pair of attachment pieces 18 can be favorably interposed and held between the corresponding pair of key supporting pieces 17 on the keyboard chassis 1 in an optimal state.

Also, in this keyboard instrument, the upper ends of each pair of key supporting pieces 17 project higher than the upper ends of each pair of attachment pieces 18, so that parts such as a substrate can be arranged above the pairs of attachment pieces 18 located on the back ends of the keys 2. That is, the upper ends of each pair of key supporting pieces 17 are positioned higher than the upper limit position of the rotation range of the corresponding key 2 at its pair of attachment pieces 18. Accordingly, parts such as a substrate can be favorably arranged on the pairs of key supporting pieces 17 without blocking the rotation of each key 2 in the vertical direction. As a result of this structure, with the keyboard instrument, the downsizing of the entire apparatus can be achieved.

Figure 12:
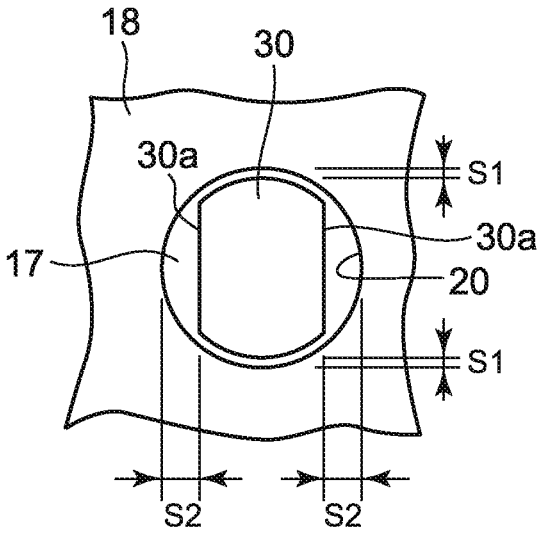
FIG. 12 is an enlarged view of a main portion showing a first modification example of the corresponding relation between the shaft hole and the shaft section shown in FIG. 4A.

In the above-described embodiment, each shaft hole 20 has an exact circular shape and each shaft section 21 has an oval shape that is long in the vertical direction. However, the present invention is not limited thereto. For example, a structure such as that of a first modification example shown in FIG. 12 may be adopted, in which each shaft section 21 has cutout sections 30*a* provided on both sides of the outer circumference surface of its round bar shape in the longitudinal direction (front-rear direction) of the corresponding key 2. In this structure as well, when each shaft section 30 is in the corresponding shaft hole 20 and the corresponding key 2 is not in a depressed state, the second spaces S2 formed in the longitudinal direction of the key 2 are larger than the first spaces S1 formed in the vertical direction of the key 2. Accordingly, by this structure as well, the same advantageous effects as those of the above-described embodiment can be acquired.

Figure 13:
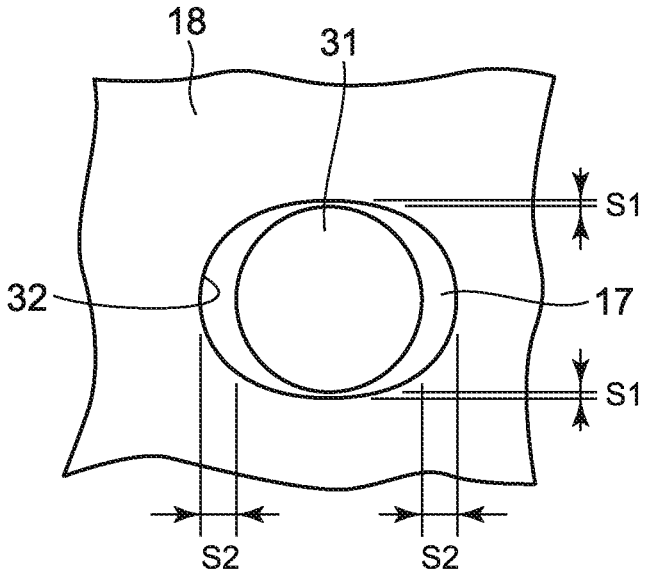
FIG. 13 is an enlarged view of a main portion showing a second modification example of the corresponding relation between the shaft hole and the shaft section shown in FIG. 4A.

Also, although the above-described embodiment has the structure where each shaft hole 20 has an exact circular shape and each shaft section 21 has an oval shape that is long in the vertical direction, the present invention is not limited thereto and, for example, a structure such as that of a second modification example shown in FIG. 13 may be adopted, in which each of the above-described shaft sections 21 has been changed to a circular shaft section 31 and each of the above-described shaft holes 20 has been changed to a long shaft hole 32 that is long in the longitudinal direction of the corresponding key 2. In this structure as well, when each shaft section 30 is in the corresponding shaft hole 20 and the corresponding key 2 is not in a depressed state, the second spaces S2 formed in the longitudinal direction of the key 2 are larger than the first spaces S1 formed in the vertical direction of the key 2. Accordingly, by this structure as well, the same advantageous effects as those of the above-described embodiment can be acquired.

Moreover, in the above-described embodiment, the shaft holes 20 are provided in the pair of attachment pieces 18 of each key 2 and the shaft sections 21 are provided on each pair of key supporting pieces 17 on the keyboard chassis 1. However, the present invention is not limited thereto. For example, a structure may be adopted in which the shaft sections 21 are provided on the pair of attachment pieces 18 of each key 2 and the shaft holes 20 are provided in each pair of key supporting pieces 17 on the keyboard chassis 1.

Furthermore, in the above-described embodiment, the pressing ribs 22 are provided on the opposing surfaces of each pair of key supporting pieces 17. However, the present invention is not limited thereto, and the pressing ribs 22 may be provided on the pair of attachment pieces 18 of each key 2.

Still further, each pressing rib 22 is not necessarily required to be provided on a straight line extending upward from the corresponding shaft section 21, and may be provided on a straight line extending downward from the corresponding shaft section 21 or on a straight line extending upward and downward from the center of the corresponding shaft section 21.

Yet still further, in the above-described embodiment, the pair of attachment pieces 18 of each key 2 is inserted between the corresponding pair of key supporting pieces 17 on the keyboard chassis 1 and thereby held on the keyboard chassis 1. However, the present invention is not limited thereto. For example, a structure may be adopted in which the pair of attachment pieces 18 of each key 2 holds therebetween the outer sides of the corresponding pair of key supporting pieces 17 on the keyboard chassis 1 and is thereby held on the keyboard chassis 1.

Yet still further, the present invention is not limited to the above-described embodiment and may adopt a structure where a keyboard instrument includes a plurality of keys and a keyboard chassis, in which each key has a shaft or a shaft hole provided on one end side thereof; the keyboard chassis is provided with shafts when the plurality of keys has shaft holes, and is provided with shaft holes when the plurality of keys has shafts; the keyboard chassis supports the plurality of keys by the shafts being arranged in the shaft holes; first spaces and second spaces are formed between an inner surface of the shaft hole and the shaft; the first spaces are positioned in a vertical direction of the key, and the second spaces are positioned in a longitudinal direction of the key; and wherein the second spaces are larger than the first spaces.

Also, a structure may be adopted in which the one end side of each key is provided with a pair of shafts or a pair of shaft holes arrayed in an array direction of the plurality of keys, and the keyboard chassis has pairs of shafts at positions corresponding to pairs of shaft holes provided in the plurality of keys, or has pairs of shaft holes at positions corresponding to pairs of shafts provided on the plurality of keys.

Moreover, a structure may be adopted in which the shafts are provided on plate-shaped portions of the plurality of keys when the shaft holes are provided in plate-shaped portions of the keyboard chassis; the shafts are provided on the plate-shaped portions of the keyboard chassis when the shaft holes are provided in the plate-shaped portions of the plurality of keys; the pressing ribs are provided projecting from the plate-shaped portions; and a space between a plate portion of each key and a corresponding plate portion of the keyboard chassis is equal to thickness of a corresponding pressing rib.

Furthermore, a structure may be adopted in which a movable distance of each shaft in a corresponding shaft hole in a longitudinal direction of a corresponding key is longer than a movable distance of the shaft in a vertical direction of the corresponding key, so that a displacement amount of the corresponding key in an array direction of the corresponding key is larger than a displacement amount of the corresponding key in an inclination direction.

Still further, whether the shaft holes are provided in the plurality of keys or are provided in the keyboard chassis, and whether the shafts are provided on the plurality of keys or are provided on the keyboard chassis may be freely determined.

Yet still further, whether the pressing ribs are provided on the plurality of keys or are provided on the keyboard chassis may be freely determined.

Yet still further, a structure may be adopted in which the U-shaped section of each key is resiliently deformed such that a length between portions provided with the shaft holes is shorter than a length between portions provided with the shafts on a corresponding pair of key supporting pieces on the keyboard chassis.

While the present invention has been described with reference to the preferred embodiments, it is intended that the invention be not limited by any of the details of the description therein but includes all the embodiments which fall within the scope of the appended claims.

What is claimed is:

1. A keyboard instrument comprising:

a plurality of keys; and a keyboard chassis, wherein each key has a shaft or a shaft hole provided on one end side thereof, wherein the keyboard chassis is provided with shafts when the plurality of keys has shaft holes, and is provided with shaft holes when the plurality of keys has shafts, wherein the keyboard chassis supports the plurality of keys by the shafts being arranged in the shaft holes, wherein first spaces and second spaces are formed between an inner surface of the shaft hole and the shaft, wherein the first spaces are positioned in a vertical direction of the key, and the second spaces are positioned in a longitudinal direction of the key, and wherein the second spaces are larger than the first spaces.

2. The keyboard instrument according to claim 1, wherein the one end side of each key is provided with a pair of shafts or a pair of shaft holes arrayed in an array direction of the plurality of keys, and wherein the keyboard chassis has pairs of shafts at positions corresponding to pairs of shaft holes provided in the plurality of keys, or has pairs of shaft holes at positions corresponding to pairs of shafts provided on the plurality of keys.

3. The keyboard instrument according to claim 1, wherein the keyboard chassis or the plurality of keys comprises pressing ribs each of which is thinner than a corresponding shaft and positioned on a straight line extending in at least one of an upper direction and a lower direction from a center of the corresponding shaft.

4. The keyboard instrument according to claim 3, wherein the shafts are provided on plate-shaped portions of the plurality of keys when the shaft holes are provided in plate-shaped portions of the keyboard chassis, and the shafts are provided on the plate-shaped portions of the keyboard chassis when the shaft holes are provided in the plate-shaped portions of the plurality of keys, wherein the pressing ribs are provided projecting from the plate-shaped portions, and wherein a space between a plate portion of each key and a corresponding plate portion of the keyboard chassis is equal to a thickness of a corresponding pressing rib.

5. The keyboard instrument according to claim 1, wherein each key includes a U-shaped section provided on the one end side, wherein the keyboard chassis has pairs of key supporting pieces which support U-shaped sections of the plurality of keys, wherein a shaft hole is provided in both sides of each U-shaped section, and wherein shafts are provided on opposing surfaces of each pair of key supporting pieces on the keyboard chassis.

6. The keyboard instrument according to claim 5, wherein a movable distance of each shaft in a corresponding shaft hole in the longitudinal direction of a corresponding key is longer than a movable distance of the shaft in the vertical direction of the corresponding key, so that a displacement amount of the plurality of keys in an array direction of the plurality of keys is larger than a displacement amount of the corresponding key in an inclination direction.

7. The keyboard instrument according to claim 5, wherein the U-shaped section of each key is resiliently deformable.

8. The keyboard instrument according to claim 7, wherein each key comprises a deformation restriction section which is provided on an upper portion of the U-shaped section and regulates resilient deformation thereof.

9. The keyboard instrument according to claim 8, wherein one end of the deformation restriction section included in each key is arranged at a position corresponding to opposing surfaces of a corresponding pair of key supporting pieces on the keyboard chassis.

10. The keyboard instrument according to claim 1, wherein each shaft hole has a circular shape and each shaft has an oval shape that is long in the vertical direction.

11. The keyboard instrument according to claim 5, wherein upper ends of the pairs of key supporting pieces on the keyboard chassis are positioned higher than a rotation range of each key on the one end side of each key.

12. The keyboard instrument according to claim 1, wherein the shaft holes are provided in the plurality of keys, and the shafts are provided on the keyboard chassis.

13. The keyboard instrument according to claim 1, wherein the shaft holes are provided in the keyboard chassis, and the shafts are provided on the plurality of keys.

14. The keyboard instrument according to claim 3, wherein the pressing ribs are provided on the plurality of keys.

15. The keyboard instrument according to claim 3, wherein the pressing ribs are provided on the keyboard chassis.

16. The keyboard instrument according to claim 7, wherein the U-shaped section of each key is resiliently deformable such that a length between portions provided with the shaft holes is shorter than a length between portions provided with the shafts on a corresponding pair of key supporting pieces on the keyboard chassis.

17. The keyboard instrument according to claim 5, wherein the plurality of keys are arranged in a horizontal direction, and the pairs of key supporting pieces on the keyboard chassis are provided corresponding to the plurality of keys.

* * * * *